United States Patent [19]

Pruitt

[11] Patent Number: 4,946,212

[45] Date of Patent: Aug. 7, 1990

[54] LIFTING MEANS FOR A PAPER ROLL

[75] Inventor: Robert C. Pruitt, Newberry, S.C.

[73] Assignee: Carolina Slings Co., Inc., Hardeeville, S.C.

[21] Appl. No.: 340,447

[22] Filed: Apr. 19, 1989

[51] Int. Cl.[5] ..... B65H 49/00; B66C 1/16

[52] U.S. Cl. ..... 294/67.1; 294/1.1

[58] Field of Search ..... 294/1.1, 67.1, 67.3, 294/67.4, 67.41, 74, 89, 158; 206/303, 386; 242/68, 68.3, 68.9, 79, 85, 85.1, 129, 129.5, 136; 414/684, 910, 911

[56] References Cited

U.S. PATENT DOCUMENTS

| | | | |
|---|---|---|---|
| 1,510,564 | 10/1924 | Stockfleth et al. | 294/67.1 |
| 1,565,077 | 12/1925 | Finn | 294/1.1 |
| 2,500,436 | 3/1950 | Swanson | 294/78 |
| 3,083,928 | 4/1963 | Voissem | 242/68.6 |
| 3,401,804 | 9/1968 | Link | 294/1.1 |
| 4,345,788 | 8/1982 | Newton | 294/1.1 |
| 4,796,939 | 1/1989 | Symonds et al. | 294/67.1 |

FOREIGN PATENT DOCUMENTS

| | | | |
|---|---|---|---|
| 53-27949 | 3/1978 | Japan | 294/74 |

*Primary Examiner*—Johnny D. Cherry

*Attorney, Agent, or Firm*—Hurt, Richardson, Garner, Todd & Cadenhead

[57] ABSTRACT

A lifting device is employed to support a roll of paper wrapped around a core, the lifting device including a flat support plate having, in its central portion, a single upstanding loop or link welded by one side to the plate. A shallow cup-shaped core cap or sleeve with an open central portion fits over and surrounds the loop so that a portion of the other side of the loop protrudes through the central portion of the cup. The ends of the loop are spaced inwardly from the sides of the cup. A continuous woven fabric or strap, formed with overlapping end portions, is received under the outer side of the loop, the overlapping end portions forming a lower bight, received between the loop and the inner perimetrical edge of the cup. The cup fits into the end of the core and the sling extends up through the hollow core so that its outer end portion protrudes outwardly of the upper end of the core for being received on a cargo hook.

11 Claims, 2 Drawing Sheets

LIFTING MEANS FOR A PAPER ROLL

FIELD OF THE INVENTION

This invention relates to a lifting device for objects having a hollow central core and is more particularly concerned with a core sling or lifting means for a roll of paper received on a central hollow core.

BACKGROUND OF THE INVENTION

In the past, numerous lifting devices have been devised for providing a sling with which a roll of paper core can be transferred from place to place by a cargo hook. Such prior art lifting devices have usually exposed the lower bight of the strap to the exterior so that the lower bight will be subjected to wear and have been relatively weak and unsuitable for repeated use. Some of the prior art core slings have also been relatively complicated and expensive to manufacture.

SUMMARY OF THE INVENTION

Briefly described, the present invention comprises a lifting device which includes a flat support plate having, at its central portion, an upstanding single, elongated loop, formed from a link of chain, the lower side portion of the loop being welded in place on the top surface of the plate. A hollow, cylindrical sleeve, the outside diameter of which is essentially the diameter of the inner periphery of the core, surrounds the loop or link and is of a height less than the height of the loop or link and has an inside diameter slightly less than the length longitudinally of the loop or link.

The flat, lower end of the sleeve is received on the upper surface of the plate and is tack welded to the plate by spaced diametrically opposed welds. The upper end of the sleeve is swagged inwardly to form an inwardly turned rim, the inner periphery or edge of which defines an opening of smaller diameter than the inner periphery of the sleeve and smaller than the maximum length of the loop or link. Diametrically opposed portions of the rim are provided with opposed recesses which confine the upper end portions of the loop or link.

A flexible sling or strap formed of a length of webbing, the ends of which are overlapped and stitched, passes through the space between the rim and the upper side of the loop or link. When the sleeve is received in one end of the core, the sling protrudes through the hollow portion of the core and outwardly therefrom so that a cargo hook can receive the upper bight of the sling.

Accordingly, it is an object of the present invention to provide a lifting device for a paper roll, which device is inexpensive to manufacture, durable in structure and efficient in operation.

Another object of the present invention is to provide a lifting device for a paper roll in which the sling thereof can be easily attached and easily replaced.

Another object of the present invention is to provide a lifting device for a paper roll in which the overlapping portion of the lifting strap or sling is confined so as to reduce shearing action on the threads which join the overlapped portions.

Another object of the present invention is to provide a lifting device for a paper roll, the lifting device being easy to install and remove on the core of the paper roll.

Another object of the present invention is to provide a lifting device for a paper roll which device can be easily manufactured using conventional tools and available parts.

Another object of the present invention is to provide a lifting device for a paper roll, which can be readily urged into the end portion of a core of the paper roll so that the plate thereof supports a substantial portion of the lower edge of the paper.

Other objects, features and advantages of the present invention will become apparent from the following description when taken in conjunction with the accompanying drawings wherein like characters of reference designate corresponding parts throughout the several views.

DETAILED DESCRIPTION

Figure 1:
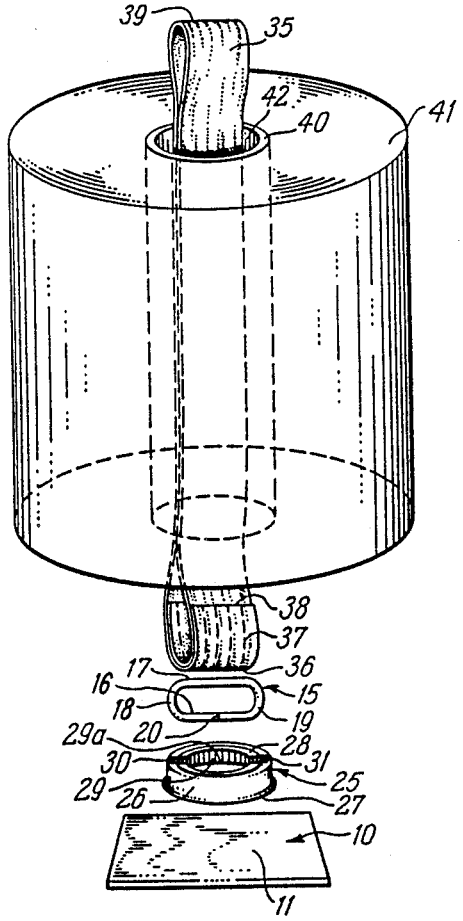
FIG. 1 is an exploded perspective view of a lifting device constructed in accordance with the present invention and receiving a conventional roll of paper thereon.

Referring now in detail to the embodiment chosen for the purpose of illustrating the present invention, numeral 10 denotes generally a flat, rectangular support plate having an upper surface 11 and a lower surface 12. The plate 10 is in a horizontal, first plane and is preferably square, being approximately six inches long and six inches wide. The thickness of the plate is usually about 5/16 inch. The plate is preferably formed of cold rolled steel.

Mounted centrally on the upper surface 11 of the plate 10 is an elongate, upstanding loop 15 which is formed from a single length of chain and has a lower side 16 and an upper side 17 which are disposed in spaced, parallel relationship to each other and are joined by opposed, generally semicylindrical ends 18 and 19. The loop or link 15 is a single length of ½ inch cylindrical rod, the ends of which are joined by welding as indicated at numeral 20 to form the lower side 16.

Figure 2:
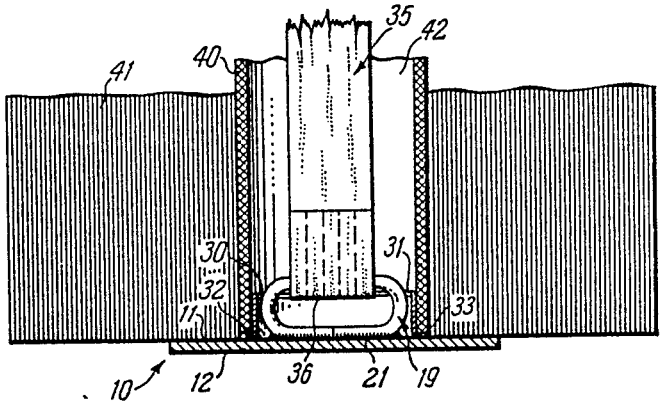
FIG. 2 is a fragmentary vertical sectional view of the lifting device and roll of paper shown in FIG. 1.
Figure 3:
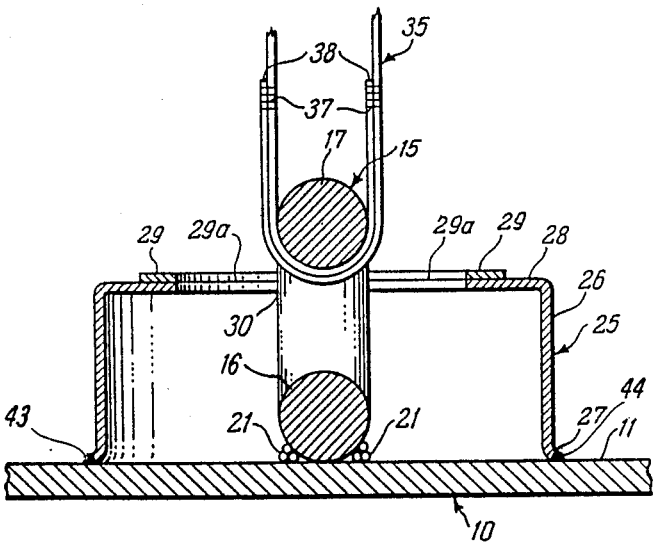
FIG. 3 is a enlarged vertical sectional view of a detail of the device shown in FIG. 1.

This lower side 16 is electro welded to the surface 11 as shown in FIG. 2, the welds 21 being on both sides of the bottom side 16 and the upper surface 11. Preferably, the loop 15 is disposed in a vertical second plane perpendicular to the horizontal plane of the surface 11, i.e. the plate 10, and midway between and parallel to opposed sides of the plate 10.

Surrounding the loop 15 is a hollow, cylindrical or slightly upwardly tapered sleeve 25 which is relatively thin as compared to the plate 10, the sleeve 25 being made of about a twenty-eight gauge, low carbon steel. It is formed from an inverted conventional core cup, the bottom portion of which is cut and stamped to provide a central opening. In more detail, the cylindrical wall 26 of the sleeve 25 has a lower outwardly flared bottom 27 which is received on the upper surface 11 so that the upstanding wall 26 surrounds at least the lower half of the loop or link 15. The ends 18 and 19 are spaced inwardly from the inner surface or periphery of the wall 26.

The upper edge portion of the sleeve 25 is provided with an annular, inwardly extending rim 28 which has at its inner periphery, a reversely bent reinforcing lip 29, concentric with the wall 26, the inner peripheral edge **29*a* of which is common with the edge of rim 28. The diameter of the inner edge 29a is less than the length of the link or loop 15. At diametrically opposed positions, the rim 28 is provided with inwardly opening, rectangular notches or recesses 30 and 31 which, when the sleeve 25 is received over the loop or link 15, will receive therein, the upper, arcuate portions of ends 18 and 19**, respectively.

The flared lower portion or bottom 27 of wall 26 is tack welded at peripherally spaced locations to the plate 11. Usually, only two tack welds 43 and 44, at diametrically opposed positions, are necessary to retain the sleeve 25 in position on the plate 10.

From the preceding structure, it will be understood that the upper side 17 of the loop or link 15 thus divides the upper rim or periphery into two equal portions which, with the upper side 17, define a pair of moon-shaped openings.

The sling or strap 35 is formed as a continuous loop of webbing or fabric, the lower bight portion 36 of which is produced by overlapping about 9 inches of the end portions of the webbing. The end portions of the overlapped portion are stitched by stitching 37 adjacent to ends 38. Thus, a plurality of two plies of the webbing are provided to protrude through each moon-shaped opening and loop under the upper end 17 of the loop or link 15. The distance between the ends, such as end 38, is sufficient that the overlapped portion of the sling or strap 35 is received in the moon-shaped spaces and are confined at their edges by the peripheral edge 29a and the sides of the upper side 17. Thus, the sling or strap 35, while being free to be moved progressively in its continuous length, nevertheless will be confined, once the overlapping portions of the lower bight 36 are installed around the upper end 17 of loop 15. The sling 35, as is conventional, is longer than the length of a conventional core 40 which receives a roll of paper 41 thereon and, thus, the sling 35 has an upper bight 39 which is available for being received on a cargo hook (not shown).

When the lifting device of the present invention is to be utilized, the strap 35 is inserted through the hollow central portion 42 of the core 40 and the outer surface of cylindrical wall 26 of the sleeve 25 is snugly received in the end portion of the core 40, as the surface 11 of plate 10 abuts the lower end portion of the core 40 and also the lower edge of the paper 41.

The tack welds 43 and 44 along the external surface of the cylindrical wall 26 and the upper surface 11 wedge into the bottom portion of core 40 and cooperate with the cylindrical wall 26 in tending to arrest rotational movement of the core 40. The plate 10 is centered by the receipt of the sleeve 25 within the end portion of core 40 and is of such a size that it protrudes outwardly beneath not only the lower end portion of the core 40 but also some of the lower end portions or edges of the paper roll 41.

In the preferred embodiment of the present invention, the plate 10 is preferably made rectangular. The chain link is about 1-¾ inches high and about 2-¾ inches long. It is preferably made of ½ inch diameter rod and is a single link of a high test or tensile chain. The inside diameter of the cup or sleeve 25 is preferably about 3 inches so that the ends of the chain link are spaced inwardly from the inner surfaces or periphery of the wall 26. The webbing for the strap or sling 35 is preferably a woven or braided, flexible fabric.

The welds 21, 43 and 44 are made using L56 electrode wire and an inert gas containing 98% argon and 2% oxygen.

It is thus seen that when the lifting device of the present invention is installed as depicted in FIG. 2, the lower bight 36 of the webbing is confined by the lower plate 10 so that it is protected against any external abrasive forces during use.

It will be obvious to those skilled in the art that many variations may be made in the embodiment here chosen for the purpose of illustrating the present invention without departing from the scope thereof as defined by the appended claims.

I claim:

1. A lifting means for a roll of paper received on a hollow, cylindrical core, said lifting means comprising:

(a) a metal supporting plate having an upper surface in a first plane;

(b) a metal loop disposed in the central portion on said upper surface of said supporting plate, said loop having a bottom side and an upper side in a common second plane and spaced from each other, said loop having ends joining the adjacent ends of said upper side and said bottom side, said common plane being perpendicular to said first plane, whereby said upper side of said loop is spaced above said upper surface;

(c) means for rigidly firmly securing said bottom side of said loop directly to said upper surface of said plate for maintaining said loop in its position perpendicular to said plate;

(d) a hollow sleeve for surrounding said loop, said sleeve having one end against said upper surface of said plate and being so dimensioned that it will protrude into one end portion of said hollow core when said lifting means is installed on said paper roll;

(e) means for securing said end of said sleeve to said upper surface of said plate;

(f) a flexible strap having an upper bight and an lower bight, said lower bight extending through said loop and around a portion of said upper side of said loop; and (g) said flexible strap being sufficiently long that it may protrude through the hollow portion of said core and outwardly of the other end portion of said hollow core so that said upper bight extends externally of said core.

2. The lifting means defined in claim 1 wherein said upper side of said loop and said lower side of said loop are parallel to each other and also parallel to said upper surface of said plate.

3. The lifting device defined in claim 1 wherein said loop is a link of a chain.

4. The lifting means defined in claim 1 wherein said sleeve is provided in its uppermost portion with an inwardly extending rim which surrounds the upper portion of said loop and also the lower bight of said strap.

5. The lifting means device defined in claim 1 wherein the upper portion of said loop extends above said sleeve.

6. The lifting means defined in claim 1 wherein said means for securing said bottom side of said loop to said plate includes welding along opposite side portions of said bottom side and along said upper surface of said plate.

7. The lifting means defined in claim 1 wherein said means for securing said end of said sleeve to said upper surface of said plate includes circumferentially spaced tack welds joining the lower portion of said sleeve to the upper surface of said plate.

8. A lifting means for a roll of paper received on a hollow, cylindrical core, said lifting means comprising:

(a) a metal supporting plate having a first plane, said metal plate having an upper surface;

(b) a metal loop disposed in the central portion of said supporting plate, said loop having a bottom side and an upper side in a common second plane and spaced from each other, said loop having ends joining the adjacent ends of said upper side and said bottom side, said common plane being perpendicular to said first plane, whereby said upper side of said loop is spaced above said upper surface;

(c) means for securing said bottom side of said loop to said plate;

(d) a hollow sleeve for surrounding said loop, said sleeve having one end against said upper surface of said plate and being so dimensioned that it will protrude into one end portion of said hollow core when said lifting means is installed on said paper roll;

(e) means for securing said end of said sleeve to said upper surface of said plate;

(f) a flexible strap having an upper bight and a lower bight, said lower bight extending around a portion of said upper side of said loop;

(g) said flexible strap being sufficiently long that it may protrude through the hollow portion of said core and outwardly of the other end portion of said hollow core so that said upper bight extends externally of said core;

(h) said sleeve being provided in its uppermost portion with an inwardly extending rim which surrounds the upper portion of said loop and also the lower bight of said strap; and (i) said rim being provided with opposed, inwardly opening recesses which receive end portions of said loop.

9. The lifting means defined in claim 8 wherein said rim has an inner edge portion which confines the lower bight of said strap in its position around a portion of said upper side of said loop.

10. The lifting means defined in claim 8 wherein said strap is formed from a single length of flexible material, the end portions of said flexible material being overlapped and stitching adjacent to the ends of said flexible material, the overlapped end portions of said strap extending around said upper side and adjacent to an inner edge portion of said rim.

11. A lifting means for a roll of paper received on a hollow, cylindrical core, said lifting means comprising:

(a) a metal supporting plate having a first plane, said metal plate having an upper surface;

(b) a metal loop disposed in the central portion of said supporting plate, said loop having a straight bottom side and a straight upper side in a common second plane and spaced from each other, said loop having ends joining the adjacent ends of said upper side and said bottom side, said common plane being perpendicular to said first plane, whereby said upper side of said loop is spaced above said upper surface;

(c) means for securing said bottom side of said loop directly to said upper surface of said plate;

(d) a flat, flexible strap having an upper bight and a lower bight, said lower bight extending around a portion of said upper side of said loop, the width of said strap being less than the distance between said ends of said loop and being sufficiently wide that said lower bight engages and extends along a substantial part of the straight portion of said upper side of said loop; and (e) said flexible strap being sufficiently long that it may protrude through the hollow portion of said core and outwardly of an upper end portion of said hollow core so that said upper bight extends externally of said core.

* * * * *